US012016407B2

(12) United States Patent
Morita et al.

(10) Patent No.: US 12,016,407 B2
(45) Date of Patent: Jun. 25, 2024

(54) NON-SLIP GLOVE

(71) Applicant: SHOWA GLOVE CO., Himeji (JP)

(72) Inventors: Takaki Morita, Himeji (JP); Takuya Sawaguchi, Himeji (JP)

(73) Assignee: SHOWA GLOVE CO., Himeji (JP)

( * ) Notice: Subject to any disclaimer, the term of this patent is extended or adjusted under 35 U.S.C. 154(b) by 0 days.

(21) Appl. No.: 17/725,778

(22) Filed: Apr. 21, 2022

(65) Prior Publication Data

US 2022/0361604 A1 Nov. 17, 2022

(30) Foreign Application Priority Data

May 14, 2021 (JP) ..... 2021-082414

(51) Int. Cl.
*A41D 19/015* (2006.01)
*A41D 19/00* (2006.01)

(52) U.S. Cl.
CPC ... *A41D 19/01547* (2013.01); *A41D 19/0055* (2013.01); *A41D 19/0065* (2013.01)

(58) Field of Classification Search
CPC ..... A41D 19/01547; A41D 19/01558; A41D 19/01505
See application file for complete search history.

(56) References Cited

U.S. PATENT DOCUMENTS 3,341,861 A * 9/1967 Robbins ..... A41D 19/01547 2/163
4,728,538 A * 3/1988 Kaspar ..... D06M 17/06 427/288
7,814,571 B2 * 10/2010 Thompson ..... B29C 41/14 2/161.6
8,302,215 B2 * 11/2012 Matsunobu ..... A41D 19/0065 2/169

(Continued)

FOREIGN PATENT DOCUMENTS

JP H4-333604 A 11/1992
JP 2008-7900 A 1/2008

*Primary Examiner* — Alissa L Hoey
*Assistant Examiner* — Akwokwo Olabisi Redhead
(74) *Attorney, Agent, or Firm* — Norris McLaughlin, P.A.

(57) ABSTRACT

An object of the present invention is to provide a non-slip glove which is superior in workability owing to ease of grasping an object and enables maintaining an antislip property for a long period of time. The non-slip glove of the present invention includes: a knitted glove main body made of fibers which includes a main body portion formed into a bag shape so as to cover a wearer's palm and dorsal hand, bottomed cylindrical first to fifth finger portions extending from the main body portion so as to cover the wearer's first to fifth fingers, respectively, and a cylindrical cuff portion extending in a direction opposite to the first to fifth finger portions; a coating layer made of a rubber or a resin which is overlaid on a palm part of the knitted glove main body and a palm side of the first to fifth finger portions; and a (Continued)

reinforcing portion made of a rubber or a resin which is interposed between the knitted glove main body and the coating layer, wherein the reinforcing portion is disposed at a position on the palm side, the position corresponding to at least carpometacarpal joints of the third to fifth fingers, a navicular bone, a lunate bone, a hamate bone, and a pisiform bone at a time of wearing.

2 Claims, 6 Drawing Sheets

(56) References Cited

U.S. PATENT DOCUMENTS

| | | | | |
|---|---|---|---|---|
| 10,004,286 | B2 * | 6/2018 | Salter | A41D 19/0024 |
| 2007/0083980 | A1 * | 4/2007 | Yang | A41D 19/0068 2/167 |
| 2009/0126074 | A1 * | 5/2009 | Mattesky | B29C 41/14 2/167 |

* cited by examiner

NON-SLIP GLOVE

BACKGROUND OF THE INVENTION

Field of Invention

The present invention relates to a non-slip glove.

Description of the Related Art

As a glove for use in agricultural work, a logistics operation, and the like, a non-slip glove in which a coating layer made of a rubber or a resin is overlaid on an outer face of a knitted glove main body is often used. In such a glove, parts that are especially likely to be abraded, such as fingertips, a thumb crotch, and the like, may be reinforced. As a reinforcement method, a method in which the thickness of the coating layer is increased (see Japanese Unexamined Patent Application, Publication No. H4-333604), a method in which the strength of fibers used for corresponding parts of the knitted glove main body is enhanced (see Japanese Unexamined Patent Application, Publication No. 2008-7900), a method in which a reinforcement patch is overlaid on an outer face of the coating layer, and the like are well-known.

PRIOR ART DOCUMENTS

Patent Documents

Patent Document 1: Japanese Unexamined Patent Application, Publication No. H4-333604

Patent Document 2: Japanese Unexamined Patent Application, Publication No. 2008-7900

SUMMARY OF THE INVENTION

In the method in which the thickness of the coating layer is increased, the coating layer becomes stiff and flexibility is decreased, and as a result, grasping an object tends to become difficult, and an insufficient cushioning property may lead to poor workability. In the method in which the strength of the fibers of the knitted glove main body is enhanced, the glove becomes slippery when the fibers are exposed due to abrasion of the coating layer, and thus the lifetime of the glove is likely to be shortened. As for the method in which the reinforcement patch is overlaid on the outer face of the coating layer, the reinforcement patch is likely to peel off owing to a load in use, and thus the lifetime of the glove is likely to be shortened.

The present invention has been made in view of the aforementioned circumstances, and an object of the invention is to provide anon-slip glove which is superior in workability owing to ease of grasping an object and enables maintaining an antislip property for a long period of time.

A palm portion includes carpal bones and metacarpal bones, which are parts in the palm portion but correspond to fingers. The present inventors have focused on the fact that when an operator holds a hand against an object or carries an object with a hand, the operator pushes a lower palm part against the object while supporting or balancing the object with the above-mentioned parts which correspond to the fingers. In other words, the present inventors have ascertained that a non-slip glove which is superior in workability owing to ease of grasping an object and enables maintaining an antislip property for a long period of time can be provided by intensively reinforcing the glove's lower palm part and the balancing finger portions, to which a great force is applied, thereby completing the present invention.

A non-slip glove according to an aspect of the present invention includes: a knitted glove main body made of fibers which includes a main body portion formed into a bag shape so as to cover a wearer's palm and dorsal hand, bottomed cylindrical first to fifth finger portions extending from the main body portion so as to cover the wearer's first to fifth fingers, respectively, and a cylindrical cuff portion extending in a direction opposite to the first to fifth finger portions; a coating layer made of a rubber or a resin which is overlaid on a palm part of the knitted glove main body and a palm side of the first to fifth finger portions; and a reinforcing portion made of a rubber or a resin which is interposed between the knitted glove main body and the coating layer, wherein the reinforcing portion is disposed at a position on the palm side, the position corresponding to at least carpometacarpal joints of the third to fifth fingers, a navicular bone, a lunate bone, a hamate bone, and a pisiform bone at a time of wearing.

In the non-slip glove, the reinforcing portion is provided at the position on the palm side, the position corresponding to the carpometacarpal joints of the third to fifth fingers, the navicular bone, the lunate bone, the hamate bone, and the pisiform bone at the time of wearing, i.e., provided on the non-slip glove's lower palm part and balancing finger portions to which a great force is applied. Since the reinforcing portion is interposed between the knitted glove main body and the coating layer, peeling and the like are less likely to occur. Accordingly, the non-slip glove enables maintaining an antislip property for a long period of time. Furthermore, the reinforcing portion does not need to be provided on fingertips, and thus the non-slip glove is superior in workability owing to ease of grasping an object.

It is preferred that the reinforcing portion is not disposed at a position on the palm side, the position corresponding metacarpophalangeal joints of the second to fourth fingers at the time of wearing. By thus not disposing the reinforcing portion at the position on the palm side, the position corresponding to the metacarpophalangeal joints of the second to fourth fingers at the time of wearing, the workability of the non-slip glove can be further improved.

It is preferred that the reinforcing portion is not disposed at a position on the palm side, the position corresponding to a metacarpophalangeal joint of the fifth finger at the time of wearing. By thus not disposing the reinforcing portion at the position on the palm side, the position corresponding to the metacarpophalangeal joint of the fifth finger at the time of wearing, the workability of the non-slip glove can be further improved.

It is preferred that the reinforcing portion penetrates into the knitted glove main body, and that an area of a region of the reinforcing portion in which the rubber or the resin penetrates to an inner face of the knitted glove main body is no less than 20% and no greater than 90% of an area of the reinforcing portion. By thus setting the area of the region in which the rubber or the resin penetrates to the inner face of the knitted glove main body within the above-mentioned range, peeling of the reinforcing portion can be further inhibited while the workability of the non-slip glove is maintained.

In a region in which the reinforcing portion is overlaid, a proportion of stitches coated due to penetration of the rubber or the resin among stitches on an inner face side of the knitted glove main body is preferably no less than 10% and no greater than 80%. By thus setting the proportion of the stitches coated due to penetration of the rubber or the resin among the stitches on the inner face side of the knitted glove main body within the above-mentioned range, peeling of the reinforcing portion can be further inhibited while the workability of the non-slip glove is maintained.

The "inner face" as referred to herein means a face on a side which comes in contact with a hand wearing the glove, and the "outer face" means an opposite face. Furthermore, the "area of the reinforcing portion" means an area of a region which is surrounded by a line drawn at 1 cm inside from an end edge of a site of the reinforcing. It is to be noted that when there are a plurality of such regions, the above-mentioned term means the sum of the areas of these regions. As referred to herein, the "region of the reinforcing portion in which the rubber or the resin penetrates to the inner face of the knitted glove main body" (hereinafter, may be also simply referred to as "penetration region") means a part in which the rubber or the resin has seeped to the surface of the glove when the glove is turned inside out and the inner face thereof is observed. The area of the penetration region refers to an area of a range in which the rubber or the resin on the inner face of the glove main body can be confirmed, when a target penetration region is fixed on a horizontal plane and photographed from directly above and an obtained image is subjected to image analysis. Although the image analysis can be visually conducted, the region of the reinforcing portion and the penetration region may be judged in units of pixels using an image analysis program such as Photoshop, available from Adobe Inc. Furthermore, the "stitches coated due to penetration of the rubber or the resin" as referred to herein mean stitches, the entire surfaces of constituent yarns thereof being coated due to the above-mentioned penetration region. It is only necessary that the constituent yarns are entirely coated when seen from upper faces of the stitches, and a surface of the coated part does not need to protrude from a surface constituted by the constituent yarns of the stitches. It is to be noted that the number of stitches is visually counted; however, in a case of dense stitches, an image photographed by the above-mentioned method may be enlarged for counting. The "proportion of stitches" as referred to herein means a proportion of the number of the stitches coated as described above with respect to the number of stitches included in the region of the reinforcing portion.

Effects of the Invention

As described above, the non-slip glove of the present invention is superior in workability owing to ease of grasping an object and enables maintaining an antislip property for a long period of time.

DESCRIPTION OF THE PREFERRED EMBODIMENTS

Hereafter, a glove according to an embodiment of the present invention is described in detail.

Figure 1:
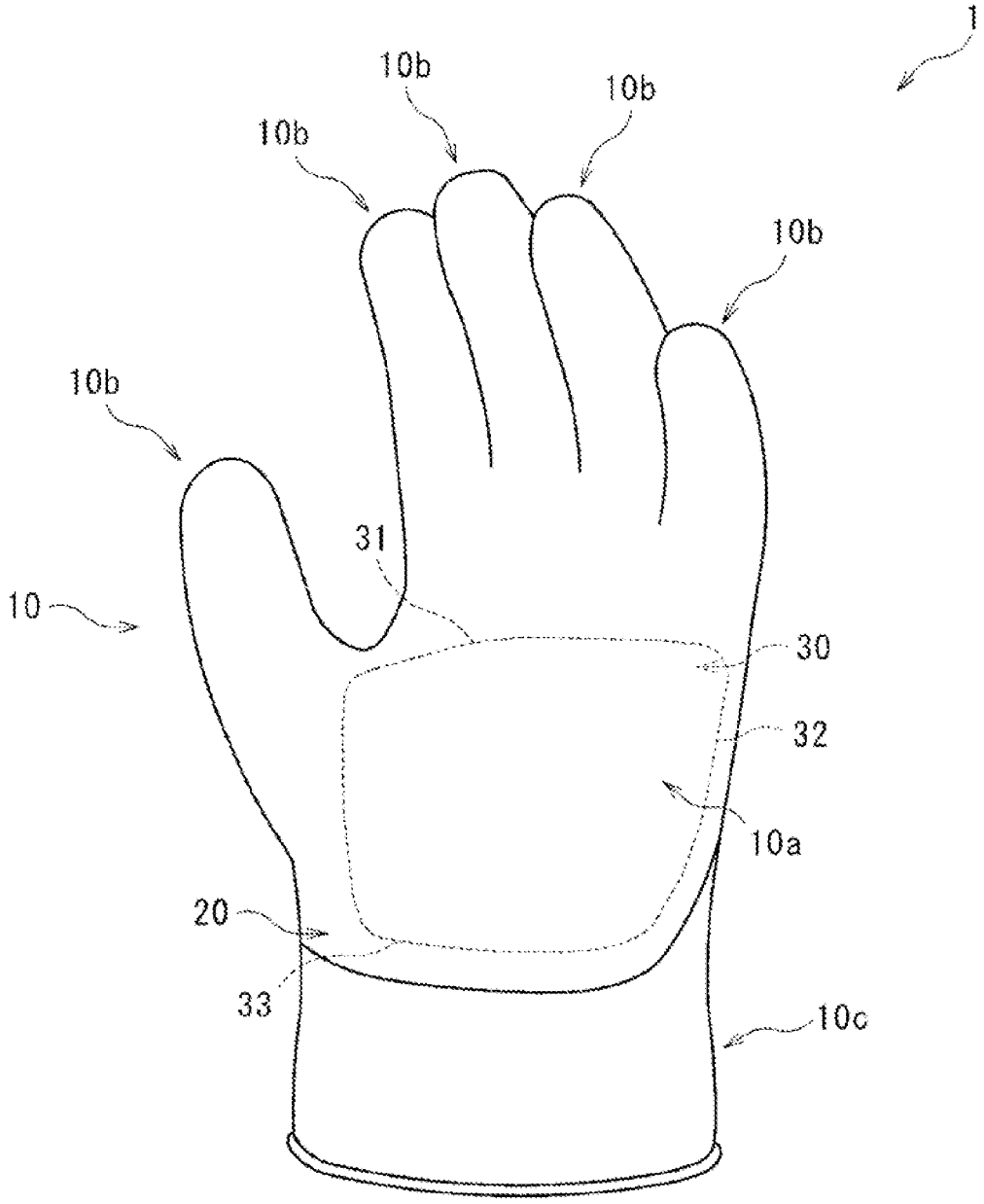
FIG. 1 is a schematic plan view from a palm side of a non-slip glove according to an embodiment of the present invention.
Figure 2:
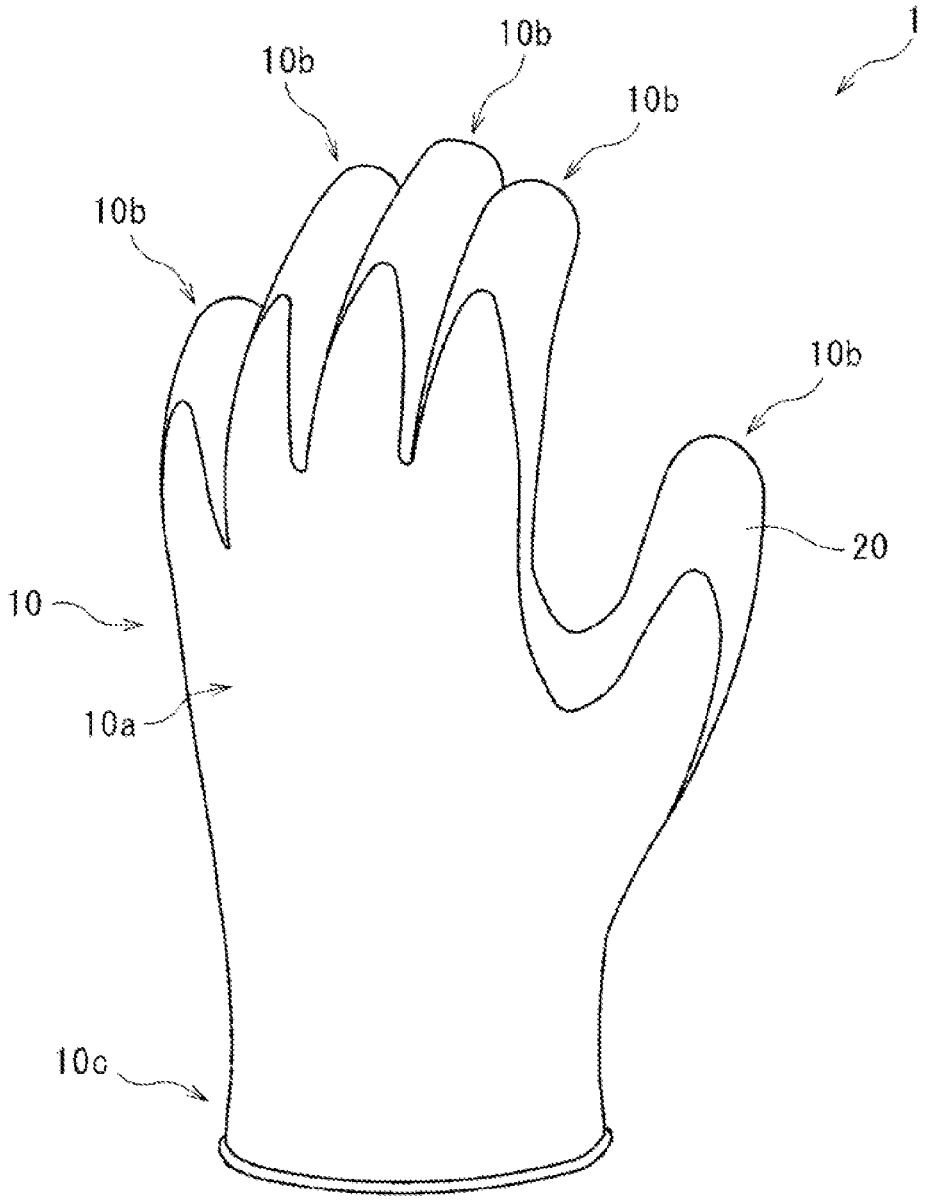
FIG. 2 is a schematic plan view from a dorsal side of the non-slip glove in FIG. 1.

A non-slip glove 1 illustrated in FIGS. 1 and 2 includes a knitted glove main body 10, a coating layer 20, and a reinforcing portion 30.

Knitted Glove

The knitted glove main body 10 includes a main body portion 10*a*, bottomed cylindrical first to fifth finger portions (hereinafter, may be also collectively referred to as "finger portions 10*b*"), and a cylindrical cuff portion 10*c*. The main body portion 10*a* is formed into a bag shape so as to cover a wearer's palm and dorsal hand, the five finger portions 10*b* extend from the main body portion 10*a* so as to cover the wearer's first to fifth fingers, respectively, and the cuff portion 10*c* extends in a direction opposite to the finger portions 10*b*. The knitted glove main body 10 is made of fibers. Since the main body is a knitted glove, the non-slip glove 1 is highly flexible. Furthermore, the knitted glove main body 10 can be formed seamlessly by using a glove knitting machine and thus can be prepared at relatively low cost, and the non-slip glove 1 can be superior in fit and touch feel as well.

Examples of a constituent yarn of the knitted glove main body 10 include a cotton yarn, a polyester yarn, a nylon yarn, a polyethylene yam, a polypropylene yam, an acrylic yam, a para-aramid yam, a meta-aramid yam, a polyparaphenylene benzoxazole (PBO) yam, an ultra-high molecular weight polyethylene yam, a drawn polyethylene yam, a glass fiber yam, a metal fiber yam, a composite yam thereof, and the like. Furthermore, an elastic fiber such as a natural rubber fiber or a polyurethane fiber may also be used in combination to provide stretchability.

As the constituent yam of the knitted glove main body 10, a spun yam, a filament yam, a composite yam, or the like, or a combination thereof may be used. In the case of using a spun yam as the constituent yam, a single yam, a two-fold yam, or a yam with a greater number of threads may be used, and a yam which has a thickness corresponding to a cotton count of no less than 3.3 and no greater than 100 in a state of combining these yarns may be used. In a case in which a filament yam is used as the constituent yam or used together with a spun yam or a composite yam, a yam which has a thickness of no less than 50 dtex and no greater than 1,500 dtex in a state of a single yam, a two-fold yam, or a combination thereof may be used.

Coating Layer

The coating layer 20 is overlaid on a palm part of the knitted glove main body 10 and a palm side of the first to fifth finger portions. The coating layer 20 is made of a rubber or a resin. The coating layer 20 imparts an antislip property to the non-slip glove 1. Furthermore, the coating layer 20 can also impart functions such as a waterproofing property and an antifouling property in oil work or the like, to the non-slip glove 1.

Examples of a principal component of the rubber which constitutes the coating layer 20 include a natural rubber, an acrylonitrile butadiene rubber, a chloroprene rubber, an acrylic rubber, an isoprene rubber, a styrene isoprene block copolymer, a silicone rubber, a mixture thereof, and the like. Of these, a natural rubber, an acrylonitrile butadiene rubber, and a chloroprene rubber are preferred in light of versatility, adhesiveness to the fibers of the knitted glove main body 10, flexibility, and abrasion resistance.

Examples of a principal component of the resin which constitutes the coating layer 20 include polyurethane, polyvinyl chloride, a mixture thereof, and the like.

Figure 4:
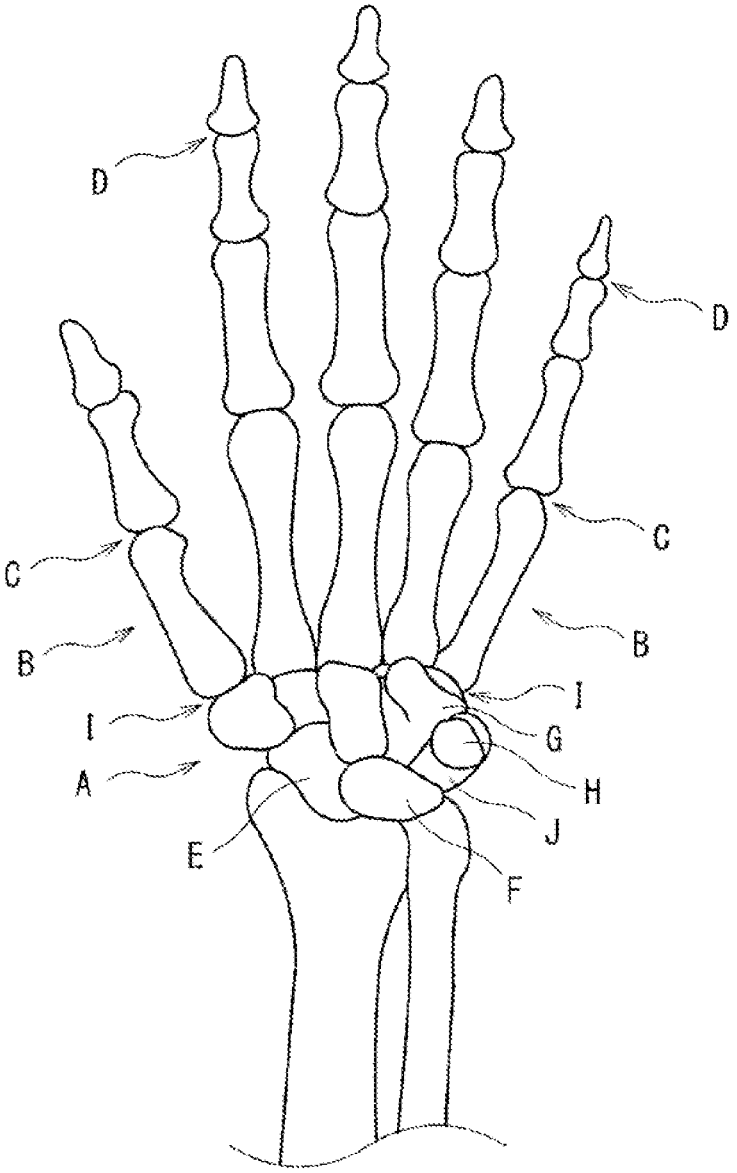
FIG. 4 illustrates sites of bones of a hand.
Figure 5:
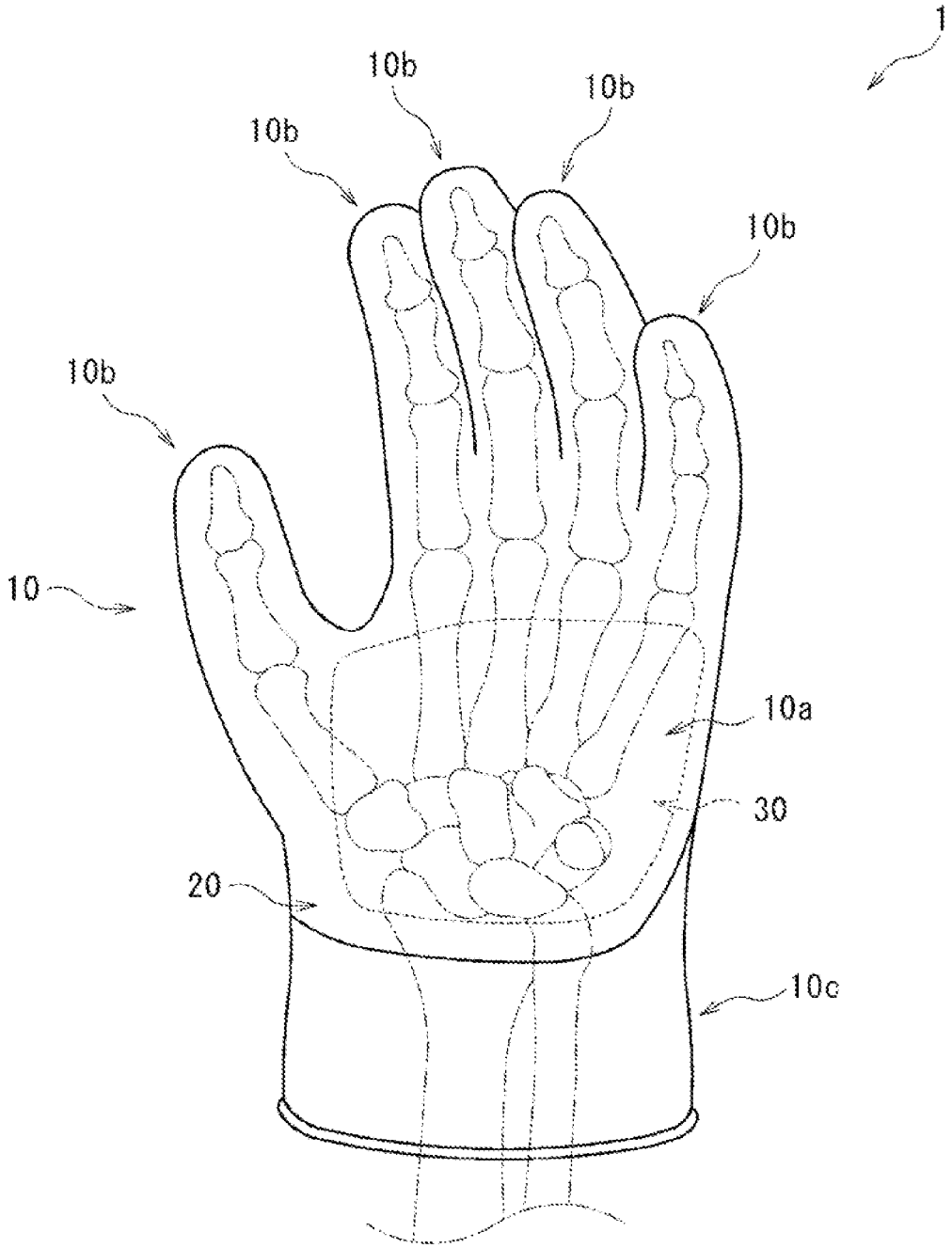
FIG. 5 is a schematic plan view illustrating a positional relationship between the non-slip glove in FIG. 1 and bones of a hand.

As illustrated in FIGS. 1 and 2, the coating layer 20 is formed on the palm part of the main body portion 10*a* of the knitted glove main body 10 and the palm side of the finger portions 10*b*. It is particularly preferred that the coating layer 20 is formed at a position on the palm side, the position corresponding to a region from carpal bones A to metacarpal bones B at a time of wearing the non-slip glove 1 (regarding the position of each bone, see FIGS. 4 and 5. The same applies hereafter). Accordingly, a superior grip property can be imparted to the non-slip glove 1, while enabling protecting the palm part.

On a dorsal side of the knitted glove main body 10, the coating layer 20 may coat an entirety of the finger portions 10*b*. Furthermore, the coating layer 20 may be formed at a position on the dorsal side, the position corresponding to metacarpophalangeal joints C at the time of wearing. By forming the coating layer 20 at the position on the dorsal side, the position corresponding to the metacarpophalangeal joints C, the metacarpophalangeal joints C can be protected. Furthermore, in FIG. 2, the coating layer 20 is formed so as to protect distal interphalangeal joints D; however, in a case in which priority is placed on finger movement, it is preferred that the coating layer 20 is formed not in the vicinity of the distal interphalangeal joints D but only nearer to a fingertip side.

It is to be noted that the coating layer 20 is formed at least on a part in which the reinforcing portion 30 is overlaid (described later). The lower limit of a coating percentage of the coating layer 20 with respect to an area of the reinforcing portion 30 is preferably 80%, more preferably 90%, and still more preferably 100%; that is to say, an entire surface of the reinforcing portion 30 is still more preferably covered with the coating layer 20. Furthermore, it is preferred that at least no less than 80%, and more preferably no less than 90% of an edge perimeter of the reinforcing portion 30 is covered with the coating layer 20.

Although an average thickness of the coating layer 20 in the region in which the reinforcing portion 30 is overlaid depends on an average thickness of the knitted glove main body 10, the lower limit of the average thickness of the coating layer 20 is preferably 0.15 mm, more preferably 0.35 mm, and still more preferably 0.55 mm. Meanwhile, the upper limit of the average thickness of the coating layer 20 is preferably 1.10 mm, more preferably 0.90 mm, and still more preferably 0.70 mm. When the average thickness of the coating layer 20 is less than the lower limit, durability of the non-slip glove 1 may be insufficient. Conversely, when the average thickness of the coating layer 20 is greater than the upper limit, flexibility of the non-slip glove 1 may be decreased, and thus usability may be degraded. It is to be noted that the "average thickness" as referred to herein means an average value of values which are measured with a digital microscope (for example, "VHX-900", available from Keyence Corporation) at 10 arbitrary points of a cross section of an object. Furthermore, the average thickness of the coating layer 20 is measured in the vicinity of a central portion of the reinforcing portion 30 (for example, a central portion of the palm).

Reinforcing Portion

Figure 3:
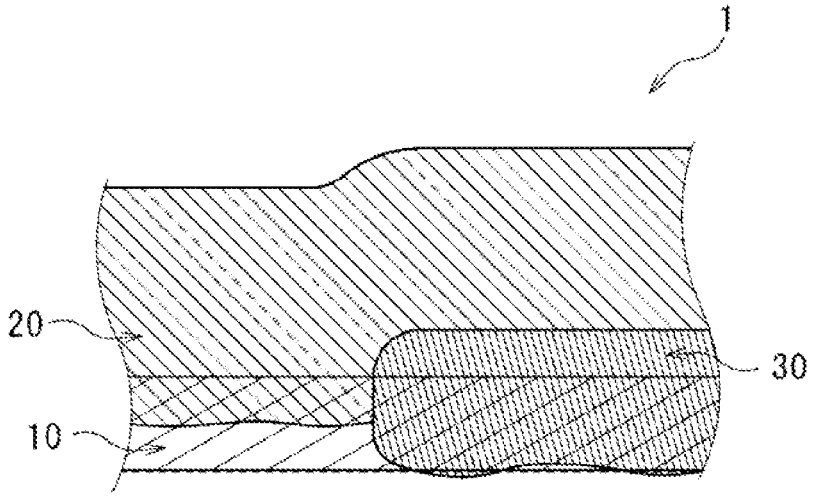
FIG. 3 is a schematic cross-sectional view illustrating a layer structure of the non-slip glove in FIG. 1.

As illustrated in FIG. 3, the reinforcing portion 30 is interposed between the knitted glove main body 10 and the coating layer 20. The reinforcing portion 30 is made of a rubber or a resin.

As examples of principal components of the rubber and the resin which constitute the reinforcing portion 30, materials that are identical to the principal components of the rubber and the resin which constitute the coating layer 20 can be exemplified. The principal components of the rubber and the resin which constitute the reinforcing portion 30 are preferably identical to the principal components of the rubber and the resin which constitute the coating layer 20, because peeling at a boundary between the reinforcing portion 30 and the coating layer 20 can be inhibited; however, different materials may also be used.

The reinforcing portion 30 is disposed at a position on the palm side, the position corresponding to at least carpometacarpal joints I of the third to fifth fingers, a navicular bone E, a lunate bone F, a hamate bone G, and a pisiform bone H at the time of wearing.

The navicular bone E, the lunate bone F, the hamate bone G, and the pisiform bone H are included in the carpal bones A. Here, the carpal bones A are described. The hand is bent at a time of grasping an object; the carpal bones A are a part which is inside the palm but corresponds to the fingers and to which a strong force is applied. The present inventors are aware that a site of the glove which corresponds to the carpal bones A is especially likely to be abraded. Furthermore, the present inventors are also aware that the site which corresponds to the carpal bones A serves as a part supporting the object at the time of grasping and thus, in a case of holding an edged object, feels pain due to a pressure thereof, and that a strong force can be applied to the navicular bone E, the lunate bone F, the hamate bone G, and the pisiform bone H of the carpal bones A, although the range of motion of joints surrounding these bones is narrow.

In other words, the position on the palm side at which the reinforcing portion 30 of the non-slip glove 1 is disposed and which corresponds to the carpometacarpal joints I of the third to fifth fingers, the navicular bone E, the lunate bone F, the hamate bone G, and the pisiform bone H at the time of wearing is a joint region which is hardly movable when the hand is fisted or opened and to which a strong force is applied at the time of grasping an object; therefore, by forming the reinforcing portion 30 in this region, abrasion of the non-slip glove 1 can be prevented. Furthermore, since the reinforcing portion 30 is disposed between the knitted glove main body 10 and the coating layer 20, peeling can be prevented.

The reinforcing portion 30 is not disposed at a position on the palm side, the position corresponding to the metacarpophalangeal joints C of the second to fifth fingers at the time of wearing. By thus not disposing the reinforcing portion 30 at the position on the palm side, the position corresponding to the metacarpophalangeal joints C of the second to fifth fingers at the time of wearing, the flexibility of the non-slip glove 1 can be ensured, and the workability can be further improved.

It is preferred that the reinforcing portion 30 is not disposed on a side face on a first finger side which corresponds to the fingertip side from a center of a length direction of the metacarpal bone B of the first finger at the time of wearing. Accordingly, a movement difficulty of the first finger due to the reinforcing portion 30 is less likely to occur; thus, the flexibility of the non-slip glove 1 can be ensured, and the workability can be further improved.

It is more preferred that the reinforcing portion 30 is not disposed on the side face on the first finger side which corresponds to the metacarpal bone B of the first finger at the time of wearing. Accordingly, a movement difficulty of the first finger due to the reinforcing portion 30 is further less likely to occur; thus, the flexibility of the non-slip glove 1 can be ensured, and the workability can be further improved.

A fingertip-direction end edge 31 (see FIG. 1) of the second to fifth fingers of the reinforcing portion 30 is preferably positioned in a region which corresponds to an area from the carpometacarpal joint I sides of the metacarpal bones B to ⅔ of a length of the metacarpal bones B at the time of wearing. This enables the second to fifth fingers to move more easily; thus, the workability can be improved, and a required reinforcement effect is easily obtained.

The reinforcing portion 30 is preferably disposed on a side face on the fifth finger side which corresponds to a triquetral bone J at the time of wearing. In other words, on the side face on the fifth finger side of the non-slip glove 1, the reinforcing portion 30 preferably extends from the palm side of the knitted glove main body 10 to the vicinity of a region that separates the palm from the dorsal hand. This enables the palm part over the triquetral bone J to be appropriately protected at the time of wearing.

A fifth finger-side side edge 32 (see FIG. 1) of the reinforcing portion 30 is preferably positioned from the palm side of the knitted glove main body 10 to the vicinity of the region that separates the palm from the dorsal hand. This enables a fit of the non-slip glove 1 to be improved, while the palm is protected.

A wrist-side end edge 33 (see FIG. 1) of the reinforcing portion 30 is preferably in a region of no greater than 2 cm, more preferably no greater than 1 cm toward the arm side from a position corresponding to the wrist-side end edge 33 of the carpal bones A at the time of wearing. Accordingly, wrist movement difficulty due to the reinforcing portion 30 is less likely to occur; thus, the flexibility of the non-slip glove 1 can be ensured, and the workability can be further improved. In addition, the palm part over the carpal bones A can be appropriately protected by the reinforcing portion 30.

As illustrated in FIG. 3, the reinforcing portion 30 penetrates into the knitted glove main body 10, and in a part of the reinforcing portion 30, the rubber or the resin forming the same penetrates to an inner face of the knitted glove main body 10. The inner face of the knitted glove main body 10 is formed of fibers. Such a knitted glove main body 10 has a favorable texture; however, when a strong force is applied to the glove while grasping an object, slippage may occur between the inner face of the knitted glove main body 10 and the palm, and sometimes an additional force needs to be applied to stably grasp the object. In the part of the reinforcing portion 30 of the non-slip glove 1, the rubber or the resin penetrates to the inner face of the knitted glove main body 10, enabling inhibition of the above-mentioned slippage and facilitating a stable grasp of an object.

The lower limit of an area of a region of the reinforcing portion 30 in which the rubber or the resin penetrates to the inner face of the knitted glove main body 10 (penetration region) is preferably 20%, and more preferably 30% of the area of the reinforcing portion 30. Meanwhile, the upper limit of the area of the penetration region is preferably 90%, and more preferably 80% of the area of the reinforcing portion 30. When the area of the penetration region is less than the lower limit, slippage may occur between the inner face of the knitted glove main body 10 and the palm, and stably grasping an object may not be enabled. Furthermore, when work is done with the non-slip glove 1 on while a strong force is applied thereto, the coating layer 20 and the reinforcing portion 30 may be peeled off from the knitted glove main body 10. Conversely, when the area of the penetration region is greater than the upper limit, the non-slip glove 1 may become too stiff, and the workability may be decreased.

Figure 6:
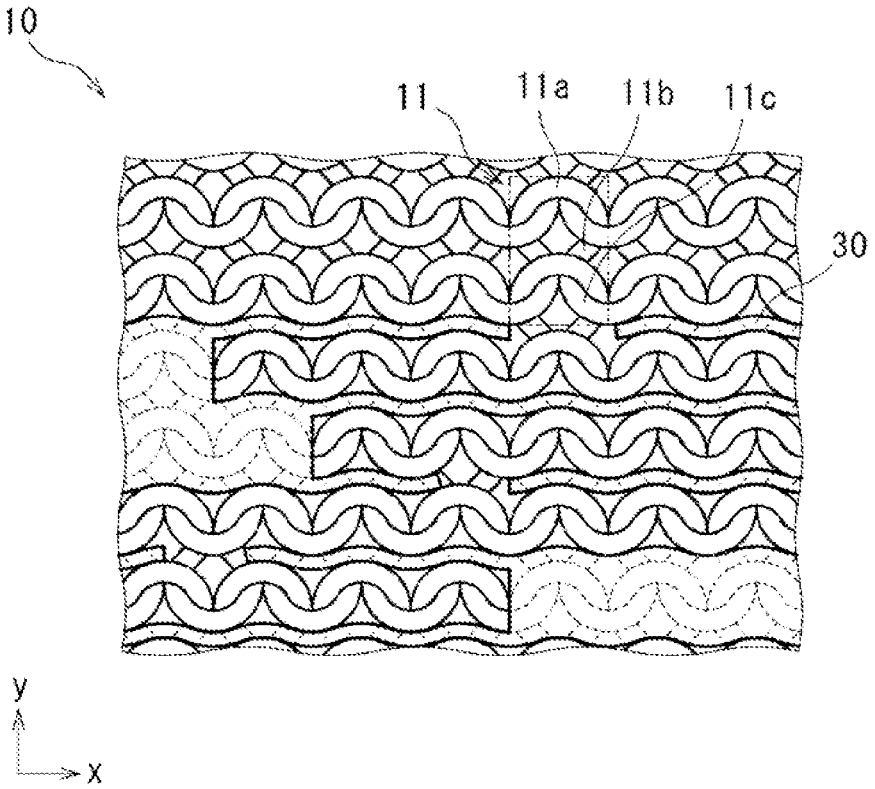
FIG. 6 is a schematic partial enlarged plan view from an inner face side of a knitted glove main body of the non-slip glove in FIG. 1.

Stitches 11 (one stitch corresponds to a part surrounded by a dashed line in FIG. 6 and is constituted by a needle loop 11*a*, a leg 11*b*, and a sinker loop 11*c*) of the knitted glove main body 10 appear continuously in a direction in which stitches forming the outer face side and stitches forming the inner face side are orthogonal to each other. Specifically, in a case in which the stitches forming the outer face side continue in a wale direction, the stitches forming the inner face side continue in a course direction; in a case in which the stitches forming the outer face side continue in the course direction, the stitches forming the inner face side continue in the wale direction. For example, FIG. 6 illustrates the knitted glove main body 10 seen from the inner face side. In the knitted glove main body 10 in FIG. 6, stitches on a front side, i.e., on the inner face side, continue in the course direction (x direction in FIG. 6), while stitches on a back side, i.e., on the outer face side, continue in the wale direction (y direction in FIG. 6). In a part in which the reinforcing portion 30 penetrates to the stitches forming the outer face side of the knitted glove main body 10, the reinforcing portion 30 preferably penetrates continuously along the direction of the stitches forming the inner face side (in FIG. 6, the course direction, i.e., the x direction). In other words, it is preferred that in the part in which the reinforcing portion 30 penetrates, the stitches forming the outer face side (the legs 11*b*) are substantially entirely covered with the reinforcing portion 30, while the stitches forming the inner face side are visible. By configuring the reinforcing portion 30 in this way, an anchor effect can prevent peeling of the reinforcing portion 30. The lower limit of a proportion of the stitches coated with the reinforcing portion 30 among the stitches forming the outer face side of the knitted glove main body 10 is preferably 70%, and more preferably 80%. Setting the proportion of the stitches to be no less than the lower limit enables more easily obtaining a peeling prevention effect due to the anchor effect.

Even in the case in which the reinforcing portion 30 penetrates to the inner face of the knitted glove main body 10, in a case in which stitches (the needle loop 11*a* and the sinker loop 11*c*) are exposed on the inner face of the knitted glove main body 10, slippage is likely to occur between the palm and the fibers of the part on which the stitches are exposed. Therefore, in the region in which the reinforcing portion 30 is overlaid, at least a part of the stitches on the inner face side of the knitted glove main body 10 is preferably coated due to penetration of the rubber or the resin.

In the region in which the reinforcing portion 30 is overlaid, the lower limit of a proportion of stitches coated due to penetration of the rubber or the resin among the stitches on the inner face side (the needle loops 11*a*) of the knitted glove main body 10 is preferably 10%, and more preferably 20%. Meanwhile, the upper limit of the proportion of the stitches is preferably 80%, and more preferably 70%. When the proportion of the stitches is less than the lower limit, slippage may occur between the inner face of the knitted glove main body 10 and the palm, and stably grasping an object may not be enabled. Furthermore, when work is done with the non-slip glove 1 on while a strong force is applied thereto, peeling may occur. Conversely, when the proportion of the stitches is greater than the upper limit, the non-slip glove 1 may become too stiff, and the workability may be decreased. It is to be noted that the sinker loops 11*c* are integrated with the needle loops 11*a* formed in advance, and thus only the number of needle loops 11*a* is counted here. Furthermore, in a case in which the knitted glove main body 10 is turned inside out, with regard to the penetration of the reinforcing portion 30, the legs 11*b* and the needle loops 11*a* in the above description correspond to the needle loops 11*a* and the legs 11*b*, respectively.

The reinforcing portion 30 can also play a role of increasing a cushioning property of the non-slip glove 1 when a strong force is applied thereto. By imparting the cushioning property to the non-slip glove 1, work comfort can be improved. Also in light of this, the reinforcing portion 30 preferably penetrates into the knitted glove main body 10.

To increase the cushioning property, the reinforcing portion 30 is preferably porous. A proportion of a volume of air accounting for a volume of the reinforcing portion 30 is preferably no less than 10% and no greater than 50%. When the proportion of the volume of air is less than the lower limit, the cushioning property may not be sufficiently imparted. Conversely, when the proportion of the volume of air is greater than the upper limit, peeling and abrasion of the reinforcing portion 30 may not be sufficiently inhibited. It is to be noted that the "proportion of the volume of air accounting for the volume of the reinforcing portion 30" as referred to herein can be calculated as a proportion of an area of a gap part with respect to a total area of a continuous region in which the reinforcing portion 30 is positioned on an outer side of yarns that constitute an outermost face of the knitted glove main body 10 when a cross section in the vicinity of a center (excluding a peripheral portion) of the reinforcing portion 30 is observed with a microscope (in other words, excluding a part in which the reinforcing portion 30 penetrates to an inner side of the yarns that constitute the outermost face of the knitted glove main body 10).

Although an average thickness of the reinforcing portion 30 depends on the average thickness of the knitted glove main body 10, the lower limit of the average thickness of the reinforcing portion 30 is preferably 0.20 mm, more preferably 0.40 mm, and still more preferably 0.60 mm. Meanwhile, the upper limit of the average thickness of the reinforcing portion 30 is preferably 1.50 mm, more preferably 1.30 mm, and still more preferably 0.90 mm. When the average thickness of the reinforcing portion 30 is less than the lower limit, effects of durability, reinforcement, and the cushioning property to be obtained may be insufficient. Conversely, when the average thickness of the reinforcing portion 30 is greater than the upper limit, the non-slip glove 1 may become too stiff. It is to be noted that the "thickness of the reinforcing portion 30" as referred to herein means a distance to an innermost face side of the reinforcing portion 30 when a perpendicular line is drawn from an outermost face of the reinforcing portion 30 toward the glove inner face. At this time, even in a case in which the reinforcing portion 30 is discontinuous due to a gap part or a yarn forming the knitted glove main body 10, the distance from the outermost face of the reinforcing portion 30 to an innermost face end is measured as the thickness of the reinforcing portion 30 by using a digital microscope. Furthermore, the "average thickness of the reinforcing portion 30" as referred to herein means an average value of values of the thickness of the reinforcing portion 30 measured at 10 points.

A ratio of the average thickness of the reinforcing portion 30 to the average thickness of the coating layer 20 at the center of the reinforcing portion 30 is preferably no less than 0.2:1 and no greater than 2:1, more preferably no less than 0.3:1 and no greater than 1.5:1, and still more preferably no less than 0.3:1 and no greater than 1:1. By setting the ratio to be within the above-mentioned range, the effects of durability, reinforcement, and the cushioning property can be more easily obtained; in addition, the flexibility of the non-slip glove 1 can be ensured to increase usability.

Method for Manufacturing Non-Slip Glove

The non-slip glove 1 can be manufactured by a method for manufacturing a non-slip glove, the method including: a step of preparing a knitted glove main body (a knitted glove main body-preparing step); a step of preparing a latex compound (a latex compound-preparing step); a step of overlaying a reinforcing portion (a reinforcing portion-overlaying step); and a step of overlaying a coating layer (a coating layer-overlaying step).

Knitted Glove Main Body-Preparing Step

In the knitted glove main body-preparing step, the knitted glove main body 10 is knitted.

The knitted glove main body 10 may be knitted from the above-mentioned constituent yarns of the knitted glove main body 10, for example, with a whole garment knitting machine or a glove knitting machine having a gauge of no less than 10 G and no greater than 26 G. Examples of the glove knitting machine include SFG-I and $SWG021N_2$, manufactured by SHIMA SEIKI MFG, LTD, and the like.

Latex Compound—Preparing Step

In the latex compound-preparing step, a latex compound for forming the coating layer 20 and the reinforcing portion 30 is prepared. A latex compound for the coating layer and a latex compound for the reinforcing portion may be prepared separately; however, in a case in which the coating layer 20 and the reinforcing portion 30 contain an identical principal component, one type of latex compound may be prepared.

The latex compound may contain, in addition to a rubber or a resin composition for forming the coating layer 20 or the reinforcing portion 30, a stabilizer such as an emulsifier or a surfactant, a vulcanizing agent such as sulfur, a vulcanization accelerator such as zinc oxide or zinc diethyldithiocarbamate, a cross-linker such as diglycidyl ether, polyglycidyl ether, polycarbodiimide, blocked isocyanate, an oxazoline group-containing polymer, or a silane coupler, a pH adjuster such as potassium hydroxide or ammonia, a thickening agent such as polyacrylic acid or carboxymethyl cellulose, a compounding agent such as a pigment or an antioxidant, and/or the like. Furthermore, in a case in which the reinforcing portion 30 is formed to be porous, besides a chemical foaming agent and/or a thermally expandable microcapsule, a foaming agent and/or a foam stabilizer may be added to mechanically foam a raw material.

Reinforcing Portion—Overlaying Step

In the reinforcing portion-overlaying step, the reinforcing portion 30 is overlaid on a desired position of the knitted glove main body 10.

The reinforcing portion 30 may be created by dip molding. Specifically, the reinforcing portion 30 is formed by selectively dipping a site to be formed in the latex compound.

In general, in a case in which a film of the reinforcing portion 30 is formed on the knitted glove main body 10, the knitted glove main body 10 is put on a hand mold, and subsequently, a method in which the knitted glove main body 10 which is heated is reacted with the latex compound, which has a superior thermosetting property, a method in which the knitted glove main body 10 which is impregnated with a coagulant is reacted with the latex compound, or the like is employed to control soaking such that the latex compound does not soak in the entire thickness direction of the knitted glove main body 10. On the other hand, in overlaying the reinforcing portion 30 of the non-slip glove 1, the latex compound is made to penetrate to the inner face of the knitted glove main body 10. Therefore, the latex compound to be used preferably has a low thermosetting property and high stability. Furthermore, at a time of overlaying the reinforcing portion 30, it is preferred that a coagulant is not used or that the coagulation ability of a coagulant to be used is low.

To overlay a firm film as the reinforcing portion 30, it is preferred that the reinforcing portion 30 contains few bubbles. For that purpose, air is preferably removed from the knitted glove main body 10 during dip molding, since the knitted glove main body 10 contains air. At this time, the air in the knitted glove main body 10 is more easily removed when the stitches of the knitted glove main body 10 are open. To open the stitches, a hand mold having a larger palm size than that of a generally used hand mold is preferably used. Consequently, in the reinforcing portion 30, the adhesiveness with the knitted glove main body 10 is increased.

To overlay a flexible film as the reinforcing portion 30, a foam layer is preferably formed as the reinforcing portion 30. In this case, a more superior cushioning property can be imparted to the non-slip glove 1.

Coating Layer—Overlaying Step

In the coating layer-overlaying step, the coating layer 20 is further overlaid on a desired position of the knitted glove main body 10 on which the reinforcing portion 30 has been overlaid. The coating layer 20 is formed so as to cover also the reinforcing portion 30.

The coating layer 20 may be formed by a method in which the knitted glove main body 10 which is heated is reacted with the latex compound having a superior thermosetting property, or a method in which the knitted glove main body 10 provided with the reinforcing portion 30 is dipped in a coagulant and is then reacted with the latex compound. In this case, in light of preventing peeling and maintaining flexibility, as illustrated in FIG. 3, a part in which the coating layer 20 is in direct contact with the knitted glove main body 10 preferably penetrates in a range of no less than 10% and no greater than 70% of the average thickness of the knitted glove main body 10.

After the coating layer 20 is overlaid, the non-slip glove 1 can be obtained by being thermally cured and being removed from the hand mold. It is to be noted that a water-washing step of washing with water for removing an excess coagulant, emulsifier, vulcanization accelerator, and/or the like from the non-slip glove 1 may be provided at any timing from after the overlaying of the coating layer 20 until after the removal of the non-slip glove 1 which has been thermally cured.

Furthermore, a surface of the coating layer 20 may be subjected to well-known anti-slip processing. A method for imparting an anti-slip property may be exemplified by a method in which irregularities are applied to an outer face of the coating layer 20 which includes particles; a method in which a foam layer is used as the coating layer 20; a method in which a foam layer is further provided on the outer face of the coating layer 20; a method in which, at a time of forming the coating layer 20, deliquescent particles are applied on the coating layer 20 before curing and are removed after heating, thereby forming concave shapes; a method in which, at the time of forming the coating layer 20, the coating layer 20 is swollen using a solvent and an irregular pattern is applied; a method in which irregularities are applied to the surface by hot press processing; and the like.

Advantages

In the non-slip glove 1, the reinforcing portion 30 is provided at the position on the palm side, the position corresponding to the carpometacarpal joints I of the third to fifth fingers, the navicular bone E, the lunate bone F, the hamate bone G, and the pisiform bone H at the time of wearing, i.e., provided on the non-slip glove 1's lower palm part and balancing finger portions **10*b* to which a great force is applied. Since the reinforcing portion 30 is interposed between the knitted glove main body 10 and the coating layer 20, peeling and the like are less likely to occur. Accordingly, the non-slip glove 1 enables maintaining an antislip property for a long period of time. Furthermore, the reinforcing portion 30 does not need to be provided on the fingertips, and thus the non-slip glove 1** is superior in workability owing to ease of grasping an object.

Other Embodiments

The present invention is not limited to the above embodiments and may be carried out in various modified and improved modes in addition to the aforementioned modes.

In the above embodiment, the case in which the reinforcing portion is not disposed at the position on the palm side, the position corresponding to the metacarpophalangeal joints of the second to fifth fingers at the time of wearing, is described; however, a non-slip glove in which the reinforcing portion is not disposed at a part of the position on the palm side, the position corresponding to the metacarpophalangeal joints of the second to fifth fingers, is also within the scope of the present invention. For example, in the non-slip glove, it is possible not to dispose the reinforcing portion at a position on the palm side, the position corresponding to the metacarpophalangeal joints of the second to fourth fingers at the time of wearing. Furthermore, in the non-slip glove, it is also possible not to dispose the reinforcing portion at a position on the palm side, the position corresponding to the metacarpophalangeal joint of the fifth finger at the time of wearing. Even in such a configuration, the flexibility of the non-slip glove can be ensured, and the workability can be further improved.

In the above embodiment, the case in which the reinforcing portion penetrates to the inner face of the knitted glove main body is described; however, the reinforcing portion does not necessarily need to penetrate to the inner face of the knitted glove main body.

Examples

Hereafter, the present invention is described further in detail by way of Examples; however, the present invention is not limited to the Examples below.

Knitted Glove Main Body

Three yarns having a cotton count of 20 were knitted into a glove shape with SGF-I, a 10-gauge glove knitting machine manufactured by SHIMA SEIKI MFG., LTD. A knitted glove main body was prepared by washing the knitted glove with hot water to remove oil content.

Latex for Prevulcanization

A latex for prevulcanization having a blending amount in terms of solid content shown in Table 1 was prepared. It is to be noted that the preparation was conducted such that the total solid content of the latex for prevulcanization was 52.8% by mass.

TABLE 1

| Raw materials | (Parts by mass) |
|---|---|
| Natural rubber (latex) | 100 |
| Sodium salt of naphthalenesulfonic acid formalin condensate | 1.3 |
| KOH | 0.1 |
| Ammonia casein | 0.1 |
| Wax emulsion | 3 |
| Sulfur | 1 |
| Zinc diethyldithiocarbamate | 0.5 |
| Zinc oxide | 1 |
| Titanium oxide | 0.5 |
| Bisphenol antioxidant | 1.2 |

Latex for Reinforcing Portion

Prevulcanization was performed on the latex for prevulcanization in Table 1 at 40° C. for 1 hour to obtain a prevulcanization latex, whereby a latex for a reinforcing portion having a blending amount shown in Table 2 was prepared. It is to be noted that the latex for the reinforcing portion was prepared so as to have a solid content of 49.1% by mass and a viscosity of 1,000 mPa·s. It is to be noted that the viscosity was measured using a B-type viscometer under conditions of V6 (at a rotation speed of 6 rpm) and a temperature of 25° C.

TABLE 2

| Raw materials | (Parts by mass) |
|---|---|
| Prevulcanization latex | 52.8 |
| Pigment | 1 |
| Silicone antifoam | 0.01 |
| Polyvinyl methyl ether | 1.3 |
| Wet silica powder | 5 |
| Acrylic thickener | as needed |

Latex for Coating Layer

Prevulcanization was performed on the latex for prevulcanization in Table 1 at 40° C. for 12 hours to obtain a prevulcanization latex, and a latex for a coating layer having a blending amount shown in Table 3 was prepared. It is to be noted that the latex for the coating layer was prepared so as to have a solid content of 50.9% by mass and a viscosity of 2,000 mPa·s.

TABLE 3

| Raw materials | (Parts by mass) |
|---|---|
| Prevulcanization latex | 52.8 |
| Sodium salt of naphthalenesulfonic acid formalin condensate | 0.1 |
| Zinc diethyldithiocarbamate | 0.04 |
| Pigment | 1 |
| Silicone antifoam | 0.01 |
| Polyvinyl methyl ether | 1.3 |
| Acrylic thickener | as needed |

Production of Non-Slip Glove

The knitted glove main body was put on a hand mold at a room temperature of 27° C., and a lower palm part was slowly dipped into the latex for the reinforcing portion and then pulled up. The hand mold was put into an oven and dried at 100° C. for 20 minutes to form the reinforcing portion. After cooling at room temperature, the hand mold, which was heated in an oven at 70° C., was dipped in the latex for the coating layer such that the entire palm and positions corresponding to the nails on dorsal portions of the fingers (positions at ⅓ of the length of the fingers from the fingertips) were coated, a surface was dried, and then the hand mold was dipped in xylene to form an anti-slip pattern. Subsequently, the hand mold was put into an oven and dried at 100° C. for 20 minutes. The glove was removed from the hand mold and washed with water to remove a dispersant and an excess chemical agent, and then the glove was put on the hand mold again, put into an oven, and subjected to vulcanization at 120° C. for 40 minutes. After cooling at room temperature, a non-slip glove was obtained by removing the glove from the hand mold.

The reinforcing portion of the non-slip glove was formed in a range surrounded by the centers of the metacarpal bones of the second to fifth fingers, the carpometacarpal joint of the first finger, a position at 1 cm toward the arm side from the lunate bone, and a position covering the pisiform bone. Thus, it was confirmed that the non-slip glove did not inhibit bending and stretching of the fingers and the wrist and thus was a glove having favorable workability and a superior cushioning property.

Furthermore, the reinforcing portion penetrated into the glove by 74% and coated 47% of the inner face stitches of the knitted glove main body. When a glove cross section at the center of the reinforcing portion was observed with a microscope, the average thickness of the reinforcing portion was 0.89 mm, and the average thickness of the coating layer was 0.80 mm. It was confirmed that this non-slip glove was superior in abrasion resistance and the grip property.

INDUSTRIAL APPLICABILITY

As described above, the non-slip glove of the present invention is superior in workability owing to ease of grasping an object and enables maintaining an antislip property for a long period of time.

EXPLANATION OF THE REFERENCE SYMBOLS

1 Non-slip glove
10 Knitted glove main body
10*a* Main body portion
10*b* Finger portion
10*c* Cuff portion
11 Stitch
11*a* Needle loop
11*b* Leg
11*c* Sinker loop
20 Coating layer
30 Reinforcing portion
31 Fingertip-direction end edge
32 Fifth finger-side side edge
33 Wrist-side end edge
A Carpal bones
B Metacarpal bone
C Metacarpophalangeal joint
D Distal interphalangeal joint
E Navicular bone
F Lunate bone
G Harnate bone
H Pisiform bone
I Carpometacarpal joint
J Triquetral bone

What is claimed is:

1. A non-slip glove comprising:

a knitted glove main body made of fibers which comprises a main body portion formed into a bag shape so as to cover a wearer's palm and dorsal hand at a time of wearing, bottomed cylindrical first to fifth finger portions extending from the main body portion so as to cover the wearer's first to fifth fingers, respectively, at the time of wearing, and a cylindrical cuff portion extending in a direction opposite to the first to fifth finger portions;

a coating layer made of a rubber or a resin which is overlaid on a palm part of the knitted glove main body and a palm side of the first to fifth finger portions; and a reinforcing portion made of a rubber or a resin which is interposed between the knitted glove main body and the coating layer, wherein the reinforcing portion is disposed at a position on the palm side, the position corresponding to at least carpometacarpal joints of the third to fifth fingers, a navicular bone, a lunate bone, a hamate bone, and a pisiform bone at the time of wearing, and no part of the reinforcing portion is disposed at a position on the palm side, the position corresponding to metacarpophalangeal joints of the second to fourth fingers at the time of wearing, nor at a position on the palm side, the position corresponding to a metacarpophalangeal joint of the fifth finger at the time of wearing, the reinforcing portion penetrates into the knitted glove main body, and in a part of the reinforcing portion, the rubber or the resin forming the reinforcing portion penetrates to an inner face of the knitted glove main body, the inner face being a face which comes in contact with the wearer's hand at the time of wearing the non-slip glove, and in a region in which the reinforcing portion is overlaid, a proportion of stitches coated due to penetration of the rubber or the resin among stitches on an inner face side of the knitted glove main body is no less than 10% and no greater than 80%.

2. The non-slip glove according to claim 1, wherein:

an area of a region of the reinforcing portion in which the rubber or the resin penetrates to an inner face of the knitted glove main body is no less than 20% and no greater than 90% of an area of the reinforcing portion.

* * * * *